United States Patent [19]

Thoma

[11] 4,063,857

[45] Dec. 20, 1977

[54] CONTROL UNIT FOR MOVING THE SLIDE MOLDS DURING THE PRODUCTION OF BUILDINGS

[75] Inventor: Jozsef Thoma, Budapest, Hungary

[73] Assignee: Bernard Ahl, Cologne, Germany

[21] Appl. No.: 763,622

[22] Filed: Jan. 28, 1977

[51] Int. Cl.[2] ..... B28B 7/04; E04G 11/22

[52] U.S. Cl. ..... 425/63; 425/20

[58] Field of Search ..... 425/60, 63, 64, 65; 249/10, 20

[56] References Cited

U.S. PATENT DOCUMENTS

| | | | |
|---|---|---|---|
| 1,122,982 | 12/1914 | Mumford | 425/63 |
| 1,761,055 | 6/1930 | Selway | 425/65 |
| 1,995,692 | 3/1935 | Urschel | 425/63 |
| 2,788,560 | 4/1957 | De Boisblanc | 249/20 |
| 3,252,199 | 5/1966 | Bossner | 425/65 |
| 3,453,707 | 7/1969 | Johansson | 425/63 |
| 3,497,579 | 2/1970 | Barron | 425/63 X |
| 3,521,336 | 7/1970 | Rohlf | 425/63 |
| 3,663,132 | 5/1972 | Andersson | 425/65 |

FOREIGN PATENT DOCUMENTS

| | | | |
|---|---|---|---|
| 1,300,200 | 6/1962 | France | 425/63 |
| 448,733 | 8/1927 | Germany | 425/63 |
| 2,216,004 | 4/1972 | Germany | 425/63 |
| 257,350 | 8/1926 | United Kingdom | 425/63 |
| 1,438,966 | 6/1976 | United Kingdom | 425/63 |
| 208,247 | 3/1967 | U.S.S.R. | 425/63 |

*Primary Examiner*—J. Howard Flint, Jr.

*Attorney, Agent, or Firm*—Diller, Brown, Ramik & Wight

[57] ABSTRACT

This disclosure relates to an apparatus for erecting structures from flowable and settable material and includes a lifting unit having an open ended shell supported by a carrier pivotally attached to a medial portion of an arm disposed generally radially to the structure which is to be formed, a first pair of relatively telescopically movable inner and outer members connected to an outboard end of the arm in generally tangential relationship to the structure, first means for moving the inner and outer members telescopically relative to each other, and second means for moving the inner and outer members along the arm in a synchronous manner to that of the relative telescopic motion.

20 Claims, 8 Drawing Figures

CONTROL UNIT FOR MOVING THE SLIDE MOLDS DURING THE PRODUCTION OF BUILDINGS

The present invention is directed to a novel apparatus for elevating a sliding shell for erecting structures of flowable and settable material, such as concrete, which may vary in cross-section and generally taper in an upward direction.

Because of static and/or economic reasons, tower-like, high-level structures of concrete or like flowable and settable material generally have a varying cross-section which decreases in an upward direction. Usually the peripheral dimensions also decrease in an upward direction along with a decrease in the wall thickness. Such structures are generally produced by what is known as the sliding structure technique which includes the utilization of sliding shells forming portions of lifting units which are elevated relative to the structure being built. Such lifting units also generally include a climbing rod, a hydraulic jack movable along the climbing rod, the hydraulic jack being connected to a carrier which, in turn, carries the shell skin and the carrier also being supported by an arm which traverses the structure being built. There is obviously little particular difficulty in simply elevating the lifting units if the structure which is being built is perfectly vertical and its cross-sectional thickness does not vary. However, should it be desirable to vary the cross-sectional thickness of the structure and/or form the structure at an angle other than normal to the horizontal, the shells or shell skins must be moved transversely synchronously during the elevation thereof. In this fashion, a generally cone-shaped structure can be produced having uniform wall thickness though the outer surface is conical. Heretofore conventional structures of this type were utilized solely for building cylindrical symmetrical structures and were not susceptible to forming a wall other than normal to the horizontal. Such prior art devices are generally categorized in two different groups.

One of the conventional structures utilizes generally radial beams located along the periphery of the structure to be built radiating from a center point on each of which is support track carrying the shell or shell skin can be moved by a radial screw or spindle. The shell into which the flowable and settable material is poured can therefore be moved radially inward toward or outward from the center. However, due to static dimensions of the support structure, radial beams, etc., the maximum economically acceptable structure diameter is 35 meters. Furthermore, apart from this size limitation, another drawback is that the weight of the radial beams increases rapidly in proportion into the diameter of the structure.

In the second group is structurally generally termed the "ring-type interjoist system". The interjoist system is a lattice associated with each lifting unit with the plurality of lattices being connected tangentially along the periphery of the structure in an annular symmetrical fashion. The ring-type interjoist system can be expanded or reduced in diameter and/or circumference through a mechanism associated with a lifting unit for lifting each lattice. Various sections or lattic portions of the ring-type interjoist system are altered by an identical amount in length between adjacent lifting units. Additionally, a bracing system may be utilized which is prestressed to insure the annular shape and position of the lifting units and the ring-type interjoinst system carried thereby.

In accordance with a most recent development of the latter-type, ring elements are located in a cross-shears lattice work system between adjacent lifting units. Elongation or shortening of the ring elements is effected by changing the annular position of the cross-shears. However, an undesirable phenomenon of this system which results from the reduction in the diameter of the structure which is being formed and thus in the diameter of the ring, is the fact that the lattic rods of the cross-shears lattic work system become increasingly oblique and the resulting forces occurring in the rods can be a multiple of the horizontal forces which is highly undesirable since uniformity of the structure to be formed is not assured.

In accordance with the foregoing, a primary object of this invention is to provide a novel apparatus which absorbs conventional ring forces in the direction of the forces without cross-shears lattice work systems and accomplishing the same only by utilizing arms or rods disposed transverse to the structure being formed, the apparatus including a pair of relatively telescopically movable inner and outer members connected to outboard ends of the arm and first and second moving means for synchronously moving the inner and outer members telescopically relative to each other and toward or away from the structure along the arms.

In further accordance with this invention, another object is that of connecting the pair of relatively telescopically movable inner and outer members to the outboard end portion of one or more arms and utilizing a common drive system for both moving the inner and outer members telescopically relative to each other and inwardly or outwardly along the arm or arms.

A further object of this invention is to provide a novel apparatus of the type heretofore described wherein the inner and outer members are disposed generally tangentially to the structure being formed, the arm or arms are each connected by a pivotal joint to a carrier which is, in turn, connected to means for lifting the carrier and thus shells or shell skins associated therewith vertically during a forming operation, the pivotal connection being located substantially radially in a plane relative to the structure and guided along the generatrix of the structure whereby the latter construction permits the synchronous movement of the overall system relative to the structure being erected.

In accordance with the foregoing, the novel apparatus of this invention has the advantage that the telescoping inner and outer members which form a ring about the structure to be formed include rods disposed only in the direction of force, generally radially of the structure, and preferably a section of such inner and outer relatively telescoping members are associated with four lifting units which permit much larger alterations in the desired diameter of a structure which is being formed than that permitted by known prior art.

A further advantage of the apparatus is that the telescopic inner and outer members are so interconnected with adjacent pairs of arms or beams that all components may be attached at the pivotal points along the center line of the wall or structure being formed and due to this construction, the overall system is "self-guided" eliminating all error during elevation of the shell or shell skins. For the same reason, all controls are linear and thus quite simple to monitor permitting not only perfectly cylindrical symmetrical structures to be formed, but any structure varying in its wall thickness or inclination to the horizontal.

With the above and other objects in view that will hereinafter appear, the nature of the invention will be more clearly understood by reference to the following detailed description, the appended claimed subject matter and the several views illustrated in the accompanying drawings.

Figure 1:
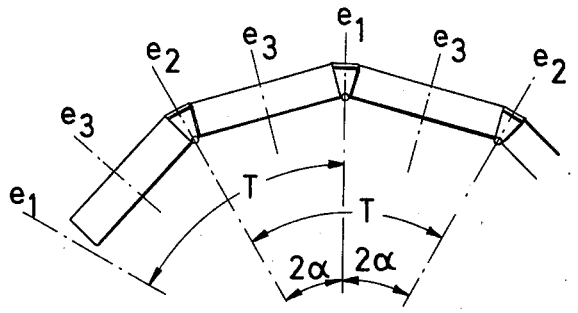
FIG. 1 is a highly schematically top plan view of a portion of the novel apparatus of this invention, and illustrates the angular relationship between and disposition of arms disposed radially of a structure to be formed and relatively telescopically movable inner and outer members carried by the arms outboard of the structure.

Before describing the novel apparatus of this invention reference is first made to FIG. 1 of the drawings which illustrates the theoretical diagram of the system when the structure which is to be built is centrally symmetrical in every plan section, i.e., a right-hand cylinder which may be constructed from concrete or other flowable and settable material. Various sections of the overall apparatus are shown as rectangular blocks (unnumbered) and are located externally of the periphery of the structure to be formed. The overall apparatus is formed by a girdle system of sections or grids which can be inserted into and withdrawn from the overall girdle system and also moved telescopically relative to each other. Furthermore, each section may additionally be moved radially toward or away from the center from which the structure being formed is generated.

Figure 2:
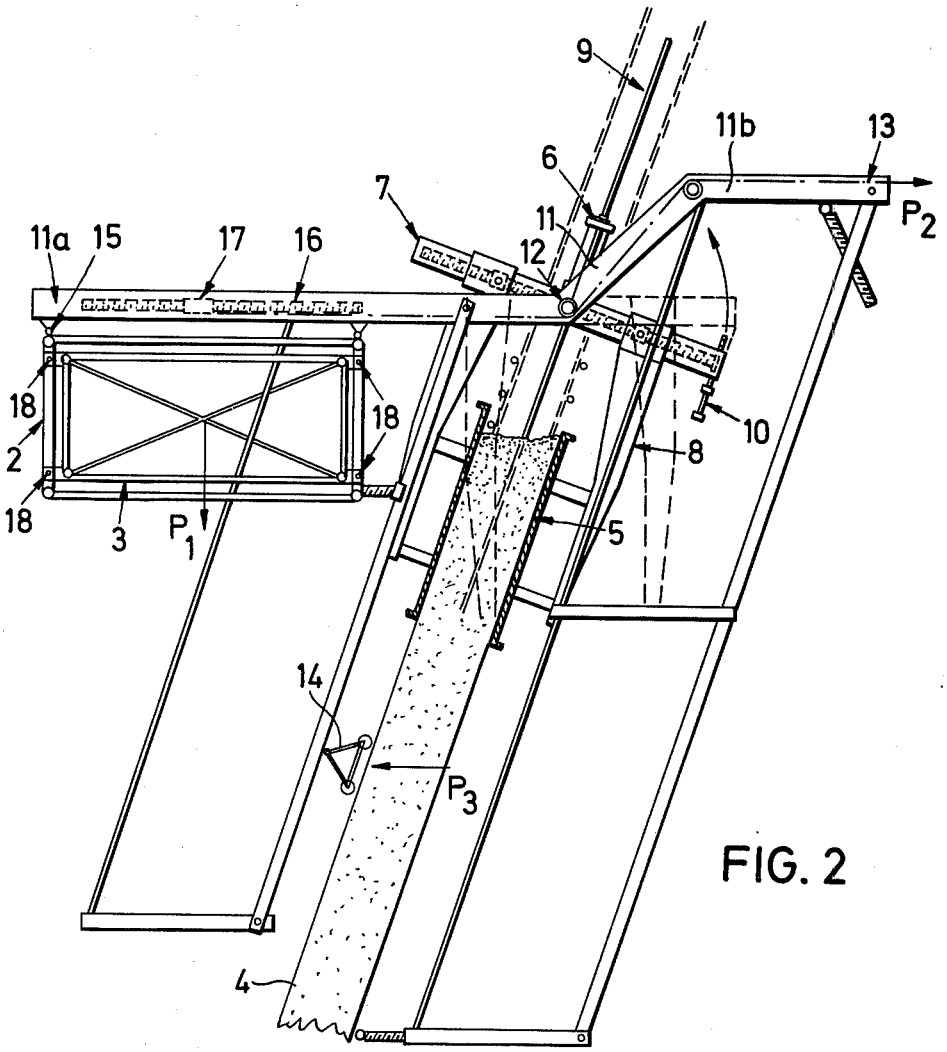
FIG. 2 is a side elevational view of the novel apparatus of this invention and illustrates an arm radially traversing the structure having pivotally connected thereto lifting means through a carrier which in turn has connected thereto a shell, and an outboard end of the arm carrying a pair of relatively telescopical members.

The overall girdle system is built up from a plurality of telescopic units T which, as will be described more fully hereinafter, are defined by inner and outer relatively telescopically movable members 2, 3, (FIG. 2). These individual telescopic units T to the right and left of bend points at radii el of the girdle system each have a symmetrical component. Each symmetrical component is an external tangential section along the periphery of the structure with which it is respectively associated at an angle $2\alpha$ between the radii from the plan center point or the center point of the structure.

Figure 3:
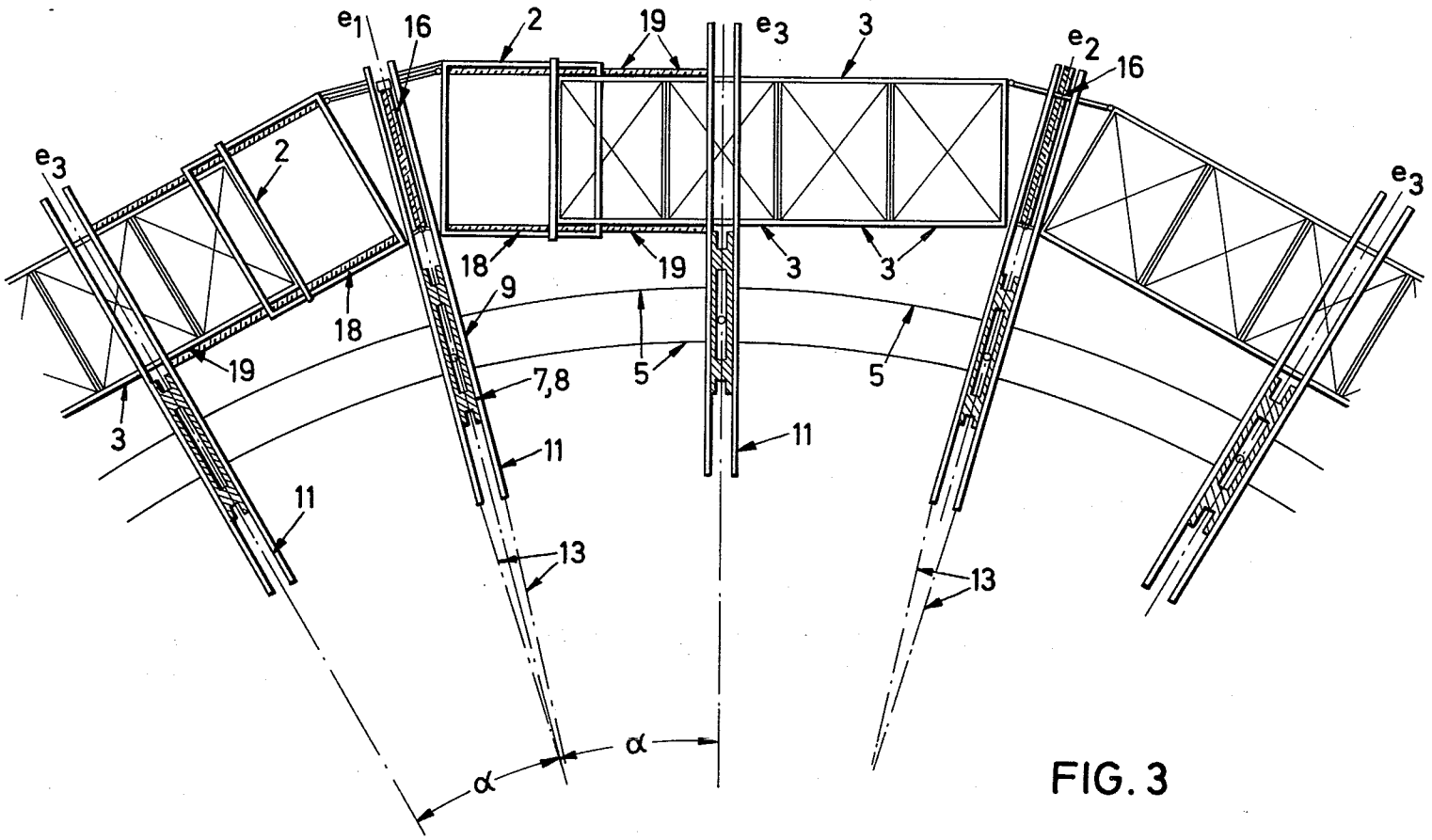
FIG. 3 is a fragmentary top plan view similar to FIG. 1, and illustrates in more detail the disposition of the arms and the relatively telescopically movable inner and outer members relative to a structure being formed.

Considering both FIGS. 1 and 3, mounted along the periphery of the structure to be formed, which is generally designated by the reference numeral 4, at each of a second bend point are the outer telescopic members 2 of the sections of the girdle system while only the inner telescopic members 3 are located at the intermediate bend points. The bend points of the outer telescopic members 2 are defined by the radii el and the bend points of the inner telescopic members 3 are defined by the radii *e*2. As specifically illustrated in FIG. 1, radii *e*3 of the section are also illustrated at the central angle $2\alpha$ although the girdle system does not bend or pivot at this point.

In addition to the relatively movable telescopic members 2 and 3, the apparatus further includes an open-ended tubular shell or shell skin 5 into which the flowable and settable material is poured. The shell 5 is connected to carrier means 7 in the form of a yoke which is connected by a pivot 12 to a pair of arms 11 and lifting means in the form of a hydraulic jack 6 which is can climb in a conventional manner along a climbing pole 9 to elevate the overall apparatus as the structural wall 4 is poured and set. Adjusting means 10 of a conventional construction utilizing screw means or a spindle (unnumbered) and associated nuts (also unnumbered) may be utilized for varying the width of the shell 5 and thus the thickness of the wall or wall structure 4. The overall unit illustrated in FIG. 2 is mounted at all of the radii *e*1, *e*2 and *e*3.

The purpose of connecting the carrier 7 to the arms 11 through the pivot or joint 12 is to permit angular torsion to take place between the latter-two components and the various structural elements carried thereby. The arms 11 at the radii *e*1 and *e*2 are secured to a central ring (not shown) located at the central axis of the structure 4 by a cable 13 which maintains the telescopic member 2, 3 under annular pressure by a radially inwardly directed force indicated by the reference character P2 (FIG. 2). The arms 11 operate in such a manner the equilibrium is achieved between the torque from the force P2 in the cable 13 and the torque from the weight P1 of a particular section (unnumbered) of the apparatus defined by one or more of the inner and outer telescopic members 3, 2 respectively. When the moment of force P2 becomes insufficient to maintain such equilibrium, a support roller 14 suitably carried by a framework (unnumbered) carried by the arms 11 contacts the formed or set wall or wall structure 4 thus providing an additional torque assisting that provided by the force P2.

An outer telescopic member 2 of the telescopic members 2, 3 is secured by detachable coupling means or connecting means 15 to an end portion 11*a* of the pair of arms 11. Screw means in the form of a threaded spindle 16 is disposed in generally parallel relationship between the pairs of arms 11, 11 in the manner best illustrated in FIG. 3 and is journalled in a conventional manner for rotation at its opposite ends. The spindle 16 has threaded thereupon a nut 17 which is connected to the cable or cables 13 in the manner best illustrated in FIG. 4. A connector element in the form of a gear 24 (FIG.

Figure 5:
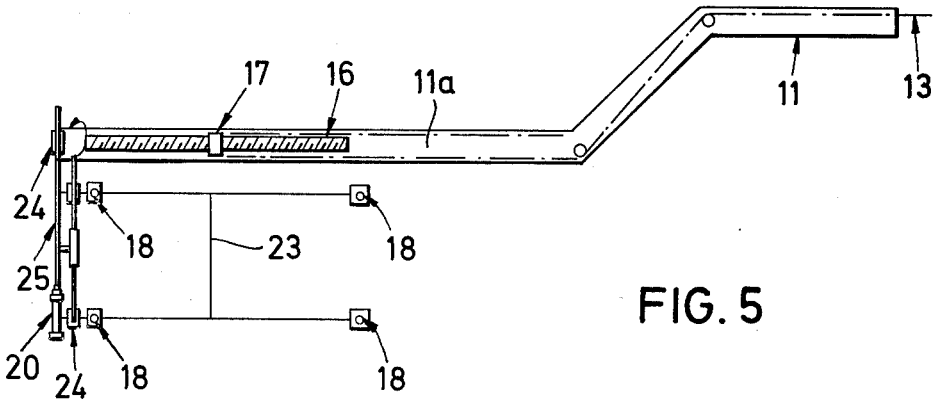
FIG. 5 is a side elevational view of the portion of the apparatus illustrated in FIG. 4, and illustrates a control system for achieving synchronous relative telescopic motion between the inner and outer members as well as movement of the latter toward or away from the structure being formed.

5) is carried by the spindle 16 in the manner best illustrated in FIG. 5 and thus motion imparted to the gear 24 rotates the spindle 16 to move the nut 17 to the right or to the left, as viewed in FIG. 5.

The outer telescopic members 2 are disposed at the bend point or radius *e*1 but proceeding from the outer telescopic members 2, only the inner telescopic members 3 extend as far as the nest bend point *e*1. The outer telescopic members 2 carry means for moving the telescopic members 2, 3 relative to each other by way of screw means or spindles 18 while the inner telescopic members 3 carry screw means or spindles 19. The shafts of these spindles 18, 19 are common to each other and thus rotation of the shaft of each spindle rotates both the spindles 18, 19 in unison but the thread pitch of the spindles 19 is one-half that of the thread pitch of the spindles 18 for the purpose of maintaining the arms 11 at the radii *e*3 at all times in the bisector of the angle between the radii *e*3 and *e*2. Suitable synchronous drive means best shown in FIGS. 4 and 5 drive the spindles 18, 19 in synchronism as well as the spindle 16 through a hydraulic motor 20 at the radii *e*1, as will be more apparent hereinafter.

Figure 4:
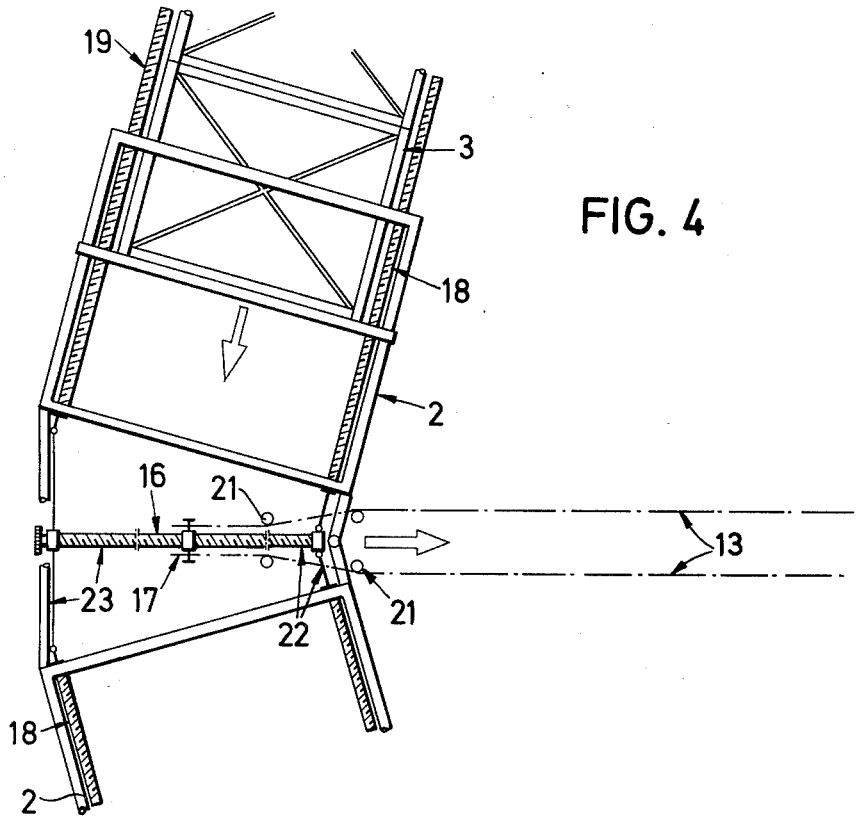
FIG. 4 is a fragmentary top plan view of a portion of FIG. 3, and illustrates details of a drive mechanism including screw means or spindles for moving the inner and outer members telescopically relative to each other as well as inwardly or outwardly along an associated arm.

Turning specifically to FIG. 4, this view illustrates the disposition of the spindles 18 relative to the outer telescopic member 2 and thus, in effect, also illustrates the disposition of the spindles 19 relative to the inner telescopic members 3. Depending upon the direction of rotation of the spindles 18, 19, the inner and outer telescopic members 3, 2 respectively, can be moved toward or away from each other as is most readily apparent in FIG. 4. Preferably, though not necessarily, the cable or cables 13 are entrained about rollers 21 before being connected to the nut 17. Conventional inner drive mechanisms 22 and outer drive mechanisms 23 are utilized for synchronously driving the spindle 16, 18 and 19 from the hydraulic motor 20. The hydraulic motor 20 (FIG. 5) essentially includes a rack 25 which is in mesh with the gear 24 such that upon the reciprocation of the rack 25, the spindle 16 is rotated clockwise or counterclockwise to move the nut 17 to the left or the right, as viewed in FIG. 5. This movement of the nut 17 is transferred to the outer telescopic member 2 through a disengagable connecting element 26 shown connected in FIG. 7 and disconnected in FIGS. 6 and 8. In addition to reciprocating the rack 25, the hydraulic motor also reciprocates another rack (unnumbered) connected thereto and between the two racks there is suitable control means (not shown) to permit the rack 25 to be engaged or disengaged from the unnumbered rack such that the spindles 16, 18 and 19 can be preferably rotated in synchronism simultaneously upon the operation of the hydraulic motor 20 or, should circumstances dictate, the rack 25 could be moved individually as might be the unnumbered rack which through suitable conventional gears or like connector means 24 drive the spindles 18, 19 of the inner and outer drive mechanisms 22, 23, respectively, However, due to the synchronous motion of the rack heretofore described, all spindles 16, 18 and 19 are preferably driven in unison to achieve the desired end result of this invention.

Figure 6:
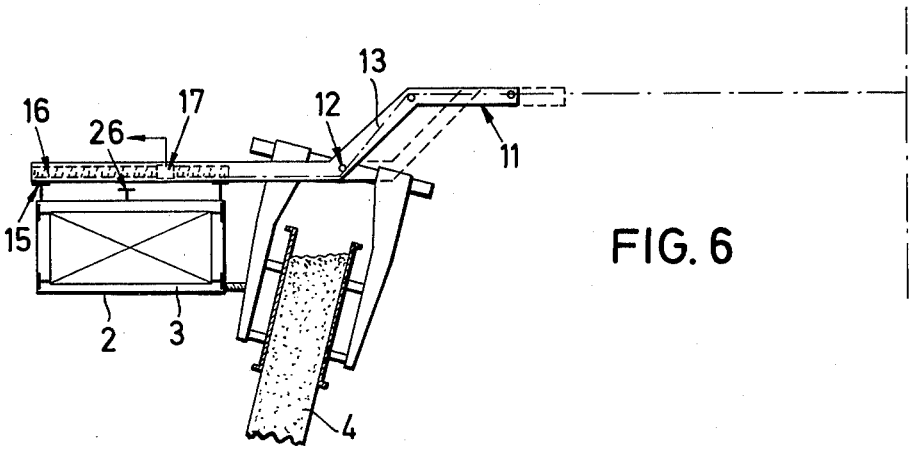
FIG. 6 is a fragmentary diagrammatic view in side elevation of the apparatus, and illustrates the disposition of the elements thereof before diameter reduction.
Figure 7:
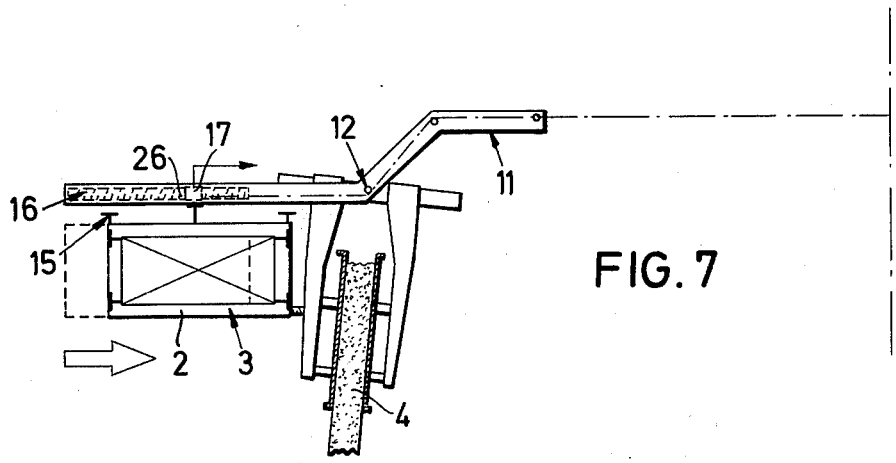
FIG. 7 is a view similar to FIG. 6, and illustrates the disposition of the elements after the diameter has been reduced.
Figure 8:
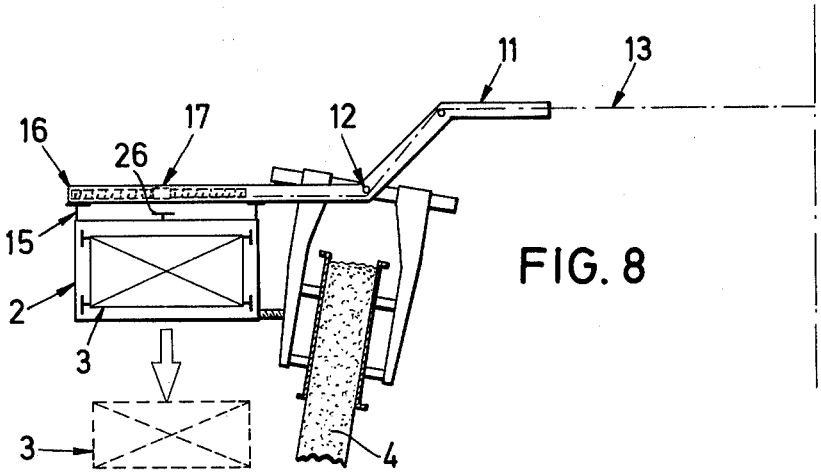
FIG. 8 is a view similar to FIGS. 6 and 7, and illustrates the manner in which one section of the inner and outer telescopic members may be removed from the system.

Reference is now made to FIG. 6 of the drawings which depicts the apparatus associated with a wall 4 which is of a relatively thick width and of a lesser angular inclination to the horizontal than that of the thinner wall 4 of FIG. 7. In view of the smaller angular inclination of the wall 4, the inner and outer telescopic members 2, 3 are disposed remote from the wall 4 and as far to the left of the arms 11 as is possible. However, should the wall 4 change to a more upright inclination, as shown in FIG. 7, the inner and outer members 2, 3 are moved to the right, as viewed in FIG. 6, from the phantom to the solid outline position illustrated in the latter-noted figure, by the rotation of the spindle 16 which drives the nut 17 to the right and thus through the connecting means 26 moves the inner and outer members 3, 2 to the right, as viewed in this same figure. Obviously, as the members 2, 3 move inwardly or to the right in FIG. 7, the telescopic members 2, 3 move relatively inwardly to reduce the peripheral extent thereof whereas outward motion causes the telescopic members 2, 3 to expand and increase the peripheral extent thereof. Moreover, should the nut 17 be moved to its maximum rightward position, the cables 13 can be disengaged therefrom and connected directly to the end or end portion 11*b* of the pair of arms 11 and the force P2 on the cable 13 moves the entire apparatus to the right to achieve further inward movement. Thereafter, the overall peripheral dimension may be such that all of the members 2, 3 are fully telescoped inwardly relative to each other and it is necessary to remove a particular section from the overall apparatus. In accordance with this invention, the releasable connecting means 26 is released, a section of the members 2, 3 is removed as shown in phantom outline in FIG. 8, and the elevating or lifting process can then again take place by repeating the process beginning with the disposition of the members 2, 3 outboardmost as shown in FIG. 6.

While preferred forms and arrangement of parts have been shown in illustrating the invention, it is to be clearly understood that various changes in details and arrangement of parts may be made without departing from the scope and spirit of this disclosure.

What is claimed is:

1. Apparatus for erecting structures from flowable and settable material comprising a lifting unit including an open ended shell into which flowable and settable material is adapted to be poured, carrier means for supporting said shell, means for elevating said carrier means whereby said shell is elevated to form a structure as the material poured thereinto eventually sets; arm means having opposite end portions, said arm means being disposed in transversely spanning relationship to the structure, means pivotally connecting said carrier means to said arm means between opposite end portions of the latter, a first pair of relatively telescopically movable inner and outer members connected to a first of said end portions outboard of the structure, said inner and outer members having axes in general tangential external relationship to the structure, first means for moving said inner and outer members telescopically relative to each other, and second means for moving said inner and outer members toward and away from the structure.

2. The apparatus as defined in claim 1 including means coupling together said first and second moving means for synchronous motion.

3. The apparatus as defined in claim 1 including a second pair of relatively telescopically movable inner and outer members connected to said first end portion, said second pair of inner and outer members having axes in general tangential external relationship to the structure, and said first moving means further telescopically move said second pair of inner and outer members relative to each other.

4. The apparatus as defined in claim 2 including a second pair of relatively telescopically movable inner and outer members connected to said first end portion; said second pair of inner and outer members having axes in general tangential external relationship to the structure, and said first moving means further telescopically move said second pair of inner and outer members relative to each other.

5. The apparatus as defined in claim 2 wherein said first moving means includes screw means.

6. The apparatus as defined in claim 2 wherein said second moving means includes screw means.

7. The apparatus as defined in claim 2 wherein said first and second moving means include screw means.

8. The apparatus as defined in claim 2 wherein said second moving means include cable means connected to said arm means, and said cable means being disposed transversely of the structure and at least partially inboard thereof.

9. The apparatus as defined in claim 2 wherein said arm means includes a second end portion disposed above said first end portion, said second moving means include cable means connected to said second end portion, and said cable means being disposed transversely of the structure and at least partially inboard thereof.

10. The apparatus as defined in claim 2 including means for releasably connecting said outer member to said arm means first end portion.

11. The apparatus as defined in claim 2 including means for releasably connecting said outer member to said arm means first end portion, and means for releasably connecting said outer member to a portion of said second moving means.

12. The apparatus as defined in claim 4 wherein said first moving means includes screw means.

13. The apparatus as defined in claim 4 wherein said second moving means includes screw means.

14. The apparatus as defined in claim 4 wherein said first and second moving means each include screw means.

15. Apparatus for erecting structures from flowable and settable material comprising a lifting unit including a plurality of open ended shells into which flowable and settable material is adapted to be poured, a plurality of carrier means for supporting said shells, means for elevating said carrier means whereby said shells are elevated to form a structure as the material poured thereinto eventually sets; a plurality of arms each having opposite end portions, said arms being disposed in transversely spanning relationship to the structure, means pivotally connecting said carrier means to said arms between opposite end portions of the latter, a plurality of pairs of relatively telescopically movable inner and outer members, means connecting said inner and outer members to first outboard end portions of said arms, said outer members being disposed adjacent each other, said inner and outer members having axes in general tangential external relationship to the structure first means for moving said inner and outer members telescopically relative to each other, and second means for moving said inner and outer members along said arms.

16. The apparatus as defined in claim 15 wherein said first moving means include first screw means coupled between said inner and outer members, and said second moving means include second screw means coupled between at least selected ones of said arm outboard end portions and said outer members.

17. The apparatus as defined in claim 15 including means coupling together said first and second moving means for synchronous motion.

18. The apparatus as defined in claim 16 including means coupling together said first and second moving means for snychronous motion.

19. The apparatus as defined in claim 18 wherein said first and second screw means are disposed generally transversely and parallel respectively to said arms.

20. The apparatus as defined in claim 19 including a nut threadedly receiving each of said second screw means, means releasably connecting said nuts to associated ones of said outer members, cable means selectively connectable to said nuts and second end portions of selected ones of said arms, a pinion carried by said second screw means, a rack in mesh with said pinion for rotating said second screw means upon movement of said rack, means for moving said rack, connecting means in mesh with said first screw means, and means for selectively connecting said rack to said connecting means for synchronously imparting said relative telescopic motion of said inner and outer members and movement of said inner and outer members along said arms.

* * * * *